US006641486B2

(12) United States Patent
Shih

(10) Patent No.: US 6,641,486 B2
(45) Date of Patent: Nov. 4, 2003

(54) BILLIARD TABLE HAVING A FOLDABLE BASE STRUCTURE

(76) Inventor: Tung Yuan Shih, No. 15-3, Chung Shan Road, Hsin Shih Shiang, Tainan Hsien (TW), 744

( * ) Notice: Subject to any disclaimer, the term of this patent is extended or adjusted under 35 U.S.C. 154(b) by 6 days.

(21) Appl. No.: 10/045,454

(22) Filed: Jan. 15, 2002

(65) Prior Publication Data

US 2003/0134683 A1 Jul. 17, 2003

(51) Int. Cl.[7] ..... A63D 13/00; A63D 15/00; A47B 3/00

(52) U.S. Cl. ..... 473/33; 473/15; 108/115; 108/121; 108/162

(58) Field of Search ..... 473/1, 3, 4, 10–15, 473/33, 9; 108/131, 133, 177, 115, 121, 162

(56) References Cited

U.S. PATENT DOCUMENTS 127,886 A * 6/1872 Hunt ..... 473/15
272,909 A * 2/1883 Shattuck ..... 108/131
317,097 A * 5/1885 Danner ..... 108/132
329,734 A * 11/1885 Gosner ..... 473/15
1,133,109 A * 3/1915 Derbyshire ..... 108/132
3,585,945 A * 6/1971 Nielsen ..... 473/33
3,988,021 A * 10/1976 Grover ..... 473/15
5,882,265 A * 3/1999 Benton ..... 473/15

* cited by examiner

*Primary Examiner*—Paul T. Sewell
*Assistant Examiner*—Mitra Aryanpour
(74) *Attorney, Agent, or Firm*—Charles E. Baxley

(57) ABSTRACT

A billiard table includes a table top, and two pairs of bars having an upper portion pivotally secured to the bottom surface of the table top with hinges and foldable toward the table top and foldable away from the table top to an open position. The table top includes two depressions formed in the bottom surface for receiving two opposite hinges, and for allowing two opposite bars to be folded to engage with the bottom surface of the table top. Two pads are secured between the table top and the other pair of bars to be engaged onto the other bars to a compact folding structure.

5 Claims, 5 Drawing Sheets

BILLIARD TABLE HAVING A FOLDABLE BASE STRUCTURE

BACKGROUND OF THE INVENTION

1. Field of the Invention

The present invention relates to a billiard table, and more particularly to a billiard table having a foldable base structure.

2. Description of the Prior Art

Typical billiard tables comprise a foot support disposed below a table top and comprise a solid configuration that may not be disengaged from each other and that may not be easily moved or transported and assembled together. The typical billiard tables thus includes a huge volume that is adverse for storing and transportation purposes.

The present invention has arisen to mitigate and/or obviate the afore-described disadvantages of the conventional billiard tables.

SUMMARY OF THE INVENTION

The primary objective of the present invention is to provide a billiard table including a foldable base structure for allowing the billiard table to be folded to a compact configuration and for facilitating the storing and the transportation of the billiard table.

In accordance with one aspect of the invention, there is provided a billiard table comprising a table top including a bottom surface, two first bars each including a lower portion, and each including an upper portion pivotally secured to the bottom surface of the table top for allowing the first bars to be folded to engage with the table top and to be folded away from the table top to an open position, and two second bars each including a lower portion, and each including an upper portion pivotally secured to the bottom surface of the table top for allowing the second bars to be folded toward the table top and to be folded away from the table top to an open position. The first bars and the second bars may be foldable to a compact structure for facilitating a storing and transportation of the billiard table.

The table top includes at least two first hinges pivotally secured between the first bars and the bottom surface of the table top, and at least two second hinges pivotally secured between the second bars and the bottom surface of the table top.

The table top includes at least two depressions formed in the bottom surface thereof for receiving the first hinges, and for allowing the first bars to be folded to engage with the bottom surface of the table top.

The table top includes at least two pads secured between the bottom surface thereof and the second hinges for spacing the second hinges from the table top, and for allowing the second bars to be folded and engaged onto the first bars after the first bars are engaged with the bottom surface of the table top.

A number of angles may further be provided and secured between the first bars and the second bars for securing the first and the second bars in the open position.

A bottom board may further be provided and secured to the lower portions of the first hinges and the second hinges, and a support device may further be provided and secured to the bottom board.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 5:
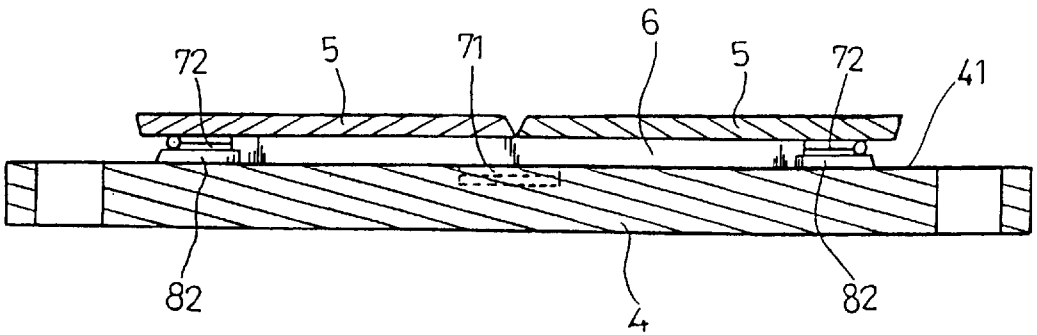
FIG. 5 is a cross sectional view similar to FIG. 4, illustrating the operation of the foldable base for the billiard table.
Figure 6:
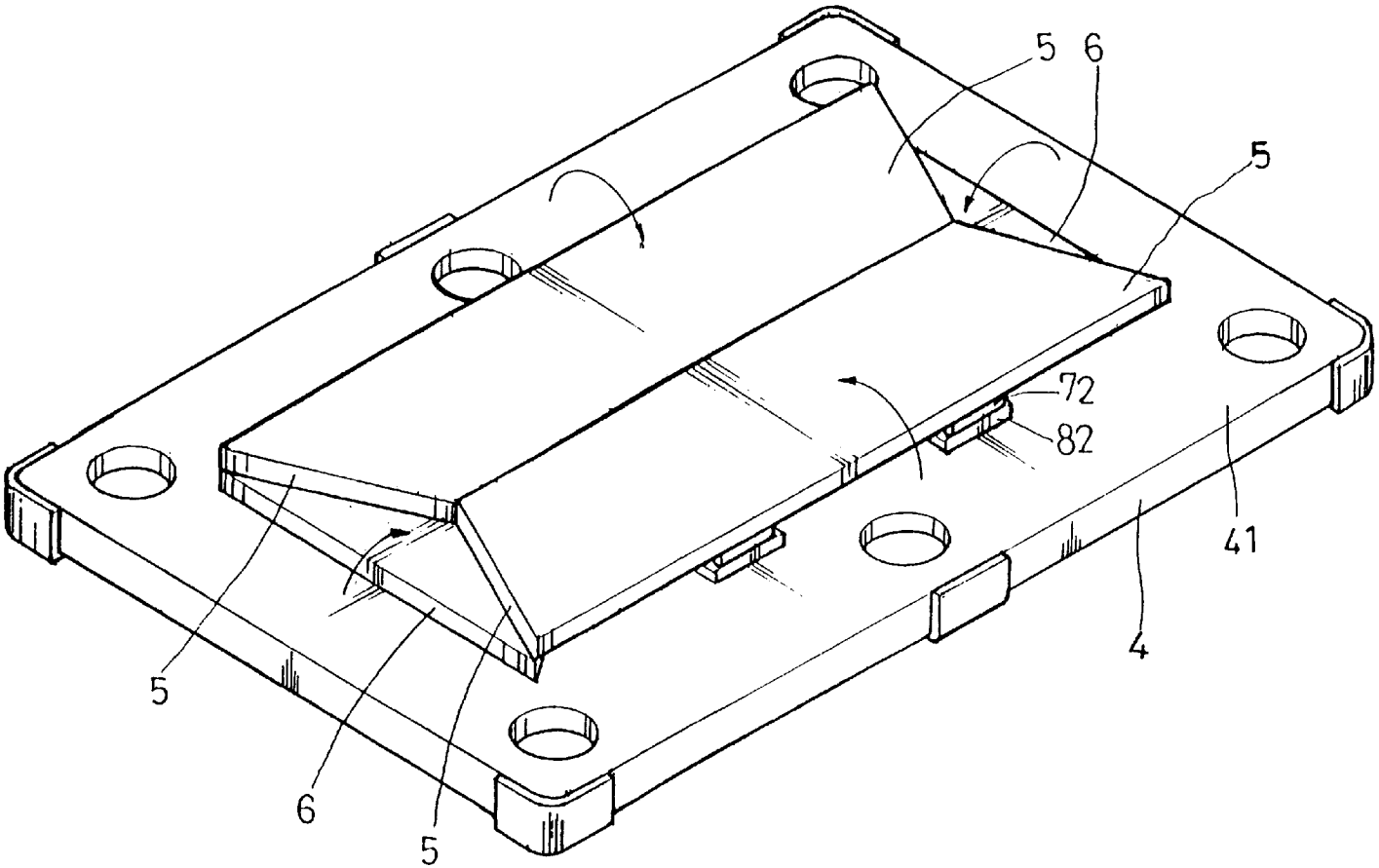
FIG. 6 is a bottom perspective view illustrating the operation of the foldable base of the billiard table.

Referring to the drawings, and initially to FIGS. 1–4, a billiard table in accordance with the present invention comprises a table top 4 including a bottom portion or a bottom surface 41. Four or two pairs of bars 5, 6 each includes an upper portion rotatably or pivotally secured to the bottom surface 41 of the table top 4 with pivot pins or hinges 71, 72, and arranged in a square or a parallelogramic structure. The pair of bars 5 are parallel to each other, and the other pair of bars 6 are parallel to each other. The table top 4 includes one or more pairs of opposite depressions 81 formed therein for receiving the hinges 71, and for allowing the bars 6 to be folded and engaged with the bottom surface 41 of the table top 4, best shown in FIGS. 5 and 6. The table top 4 further includes one or more pairs of pads 82 secured between the bottom surface 41 of the table top 4 and the hinges 72 for slightly spacing the bars 5 from the table top 4 and for allowing the bars 5 to be folded and engaged onto the bars 6 after the bars 6 have been folded to engage with the bottom surface 41 of the table top 4, best shown in FIGS. 5 and 6.

Figure 1:
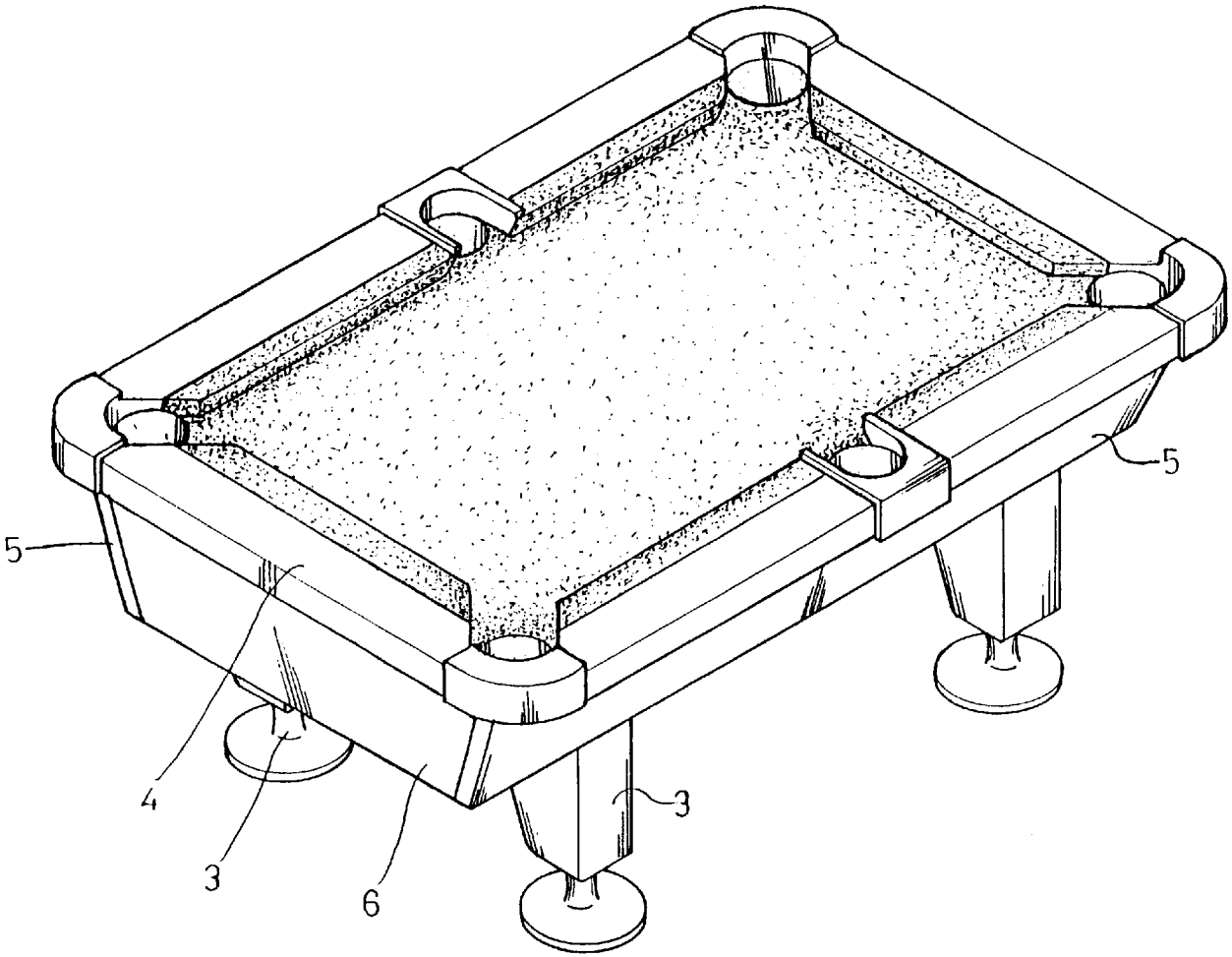
FIG. 1 is a perspective view of a billiard table in accordance with the present invention.
Figure 2:
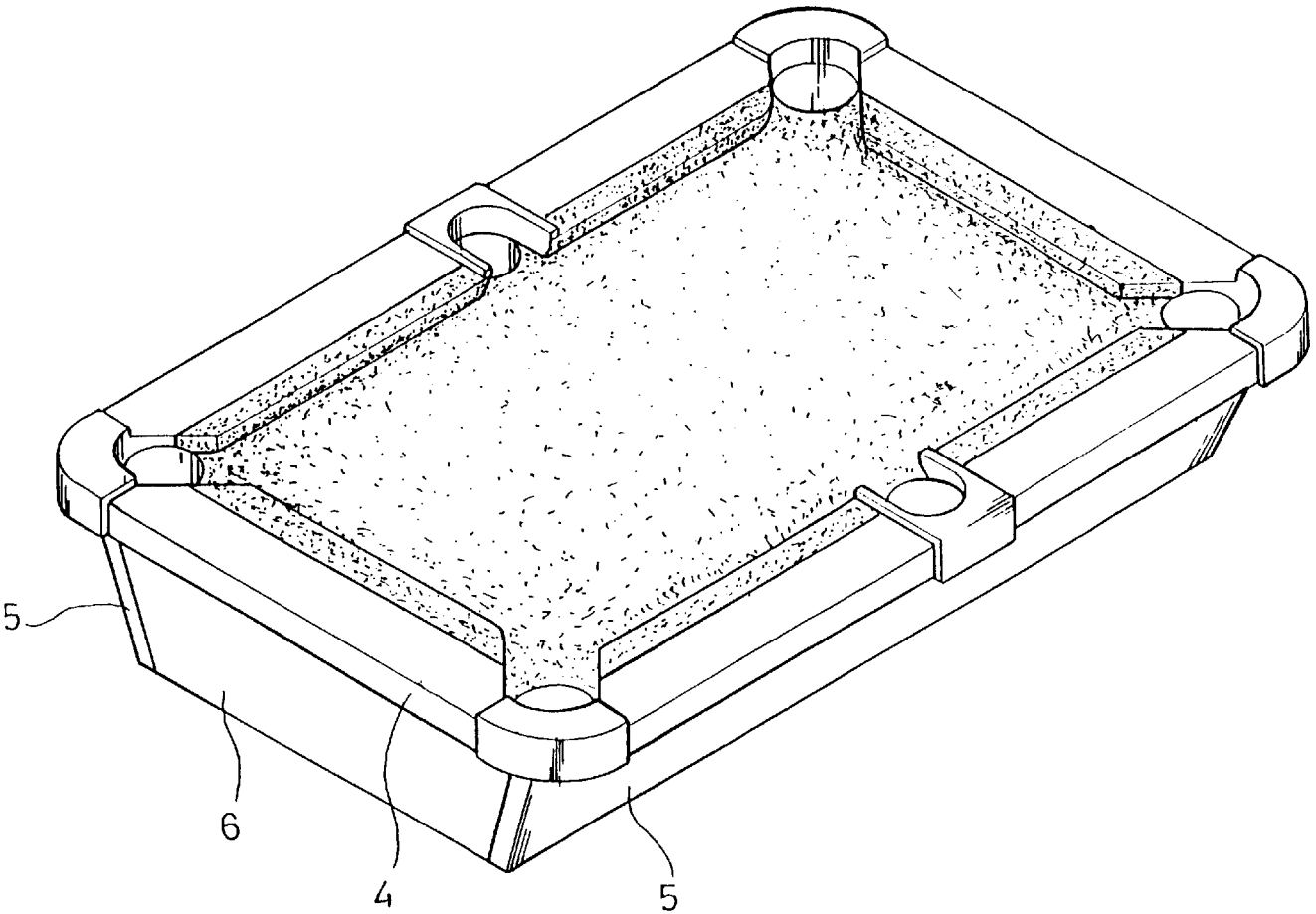
FIG. 2 is a partial perspective view of the billiard table, in which the foot support has been removed from the table top.
Figure 3:
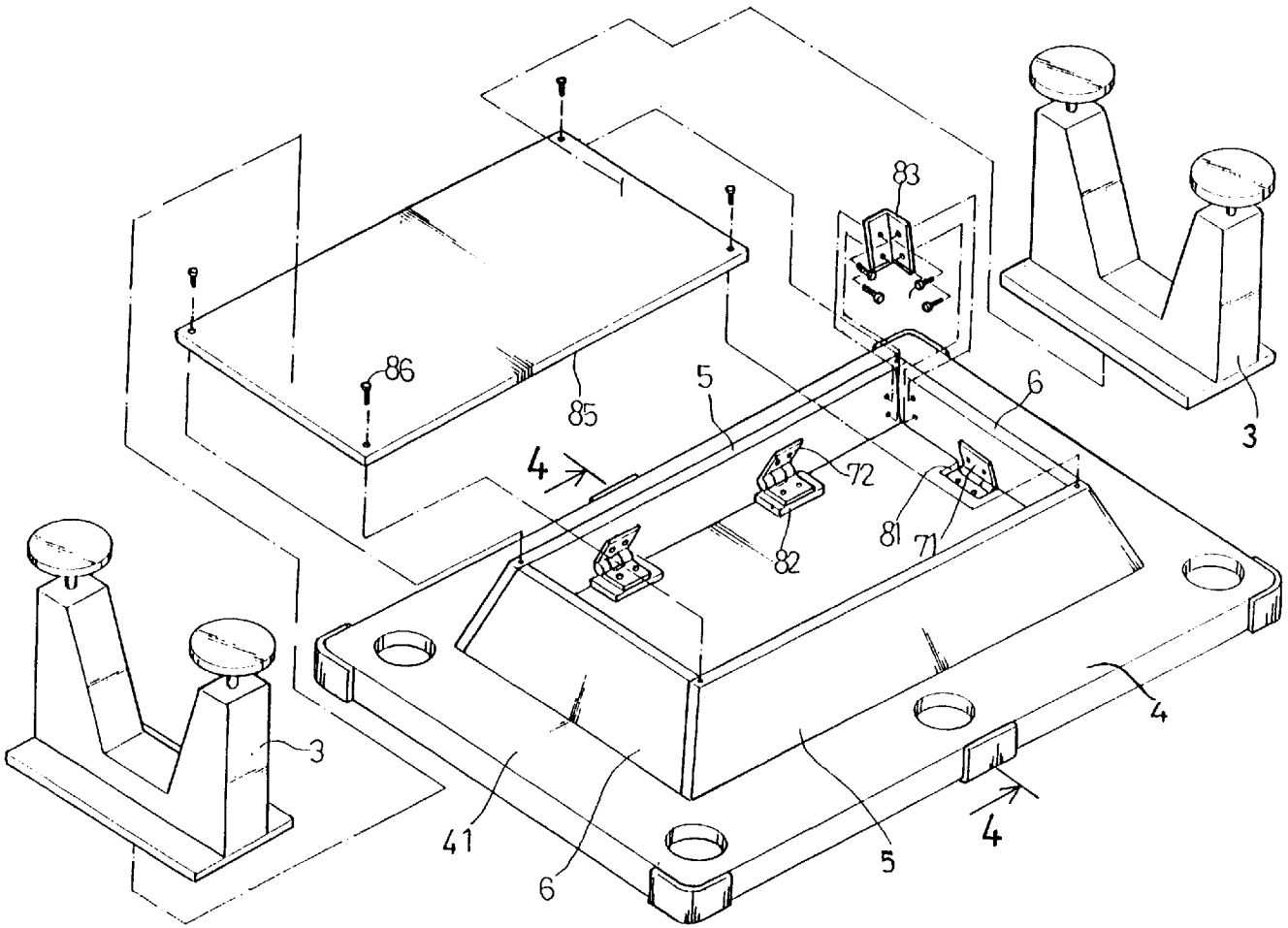
FIG. 3 is a partial exploded view of the billiard table, as seen from the bottom of the billiard table.
Figure 4:
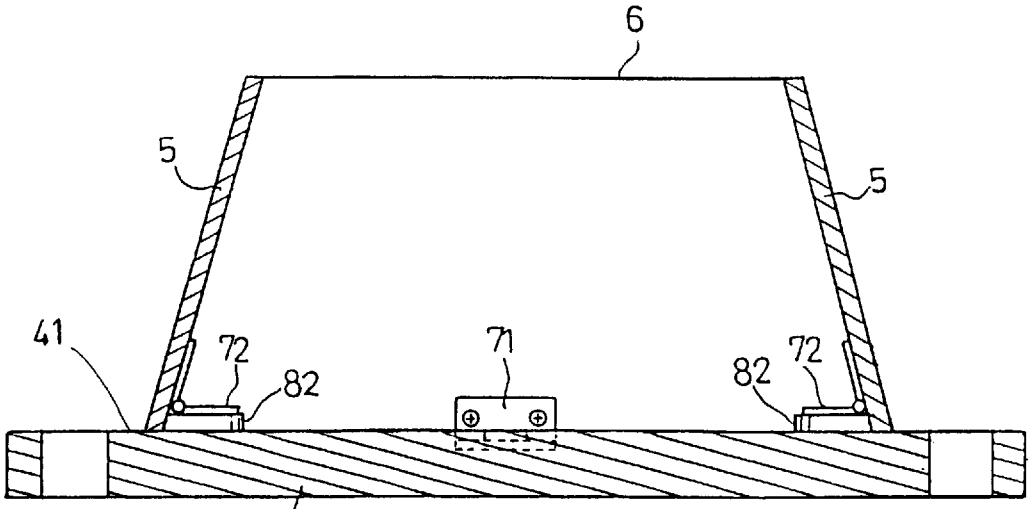
FIG. 4 is a cross sectional view taken along lines 4—4 of FIG. 3.

Four angles 83 may be secured between the bars 5, 6 and/or the table top 4, for securing the bars 5, 6 at the open position as shown in FIGS. 3 and 4, after the bars 5, 6 have been rotated away from the table top 4 or rotated to a position substantially perpendicular to the table top 4. As best shown in FIG. 4, it is preferable that the bars 5, 6 are slightly inclined relative to the table top 4 when the bars 5, 6 have been folded to the open position and secured in the open position by the angles 83. A board 85 (FIG. 3) may be secured to the bottom portions of the bars 5, 6 with fasteners 86. A support device includes two foot supports 3 which may be secured to the bottom of the board 85 with fasteners, for example.

In operation, as shown in FIGS. 3–6, the foot supports 3 may be disengaged from the bottom board 85, and the bottom board 85 may be disengaged from the bars 5, 6, and the angles 83 may be disengaged from the bars 5, 6 such that the bars 6 may be folded to engage with the table top 4, and the bars 5 may be folded to engage with the bars 6 after the bars 6 have been folded to engage with the table top 4, and such that the billiard table may be folded to a compact folding structure that is excellent for storing and transportation purposes.

Accordingly, the billiard table in accordance with the present invention includes a foldable base structure for allowing the billiard table to be folded to a compact configuration and for facilitating the storing and the transportation of the billiard table.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A billiard table comprising:

a table top including a bottom surface, two first bars each including a lower portion, and each including an upper portion pivotally secured to said bottom surface of said table top for allowing said first bars to be folded to engage with said table top and to be folded away from said table top to an open position, two second bars each including a lower portion, and each including an upper portion pivotally secured to said bottom surface of said table top for allowing said second bars to be folded toward said table top and to be folded away from said table top to an open position, said first bars and said second bars being foldable to a compact structure for facilitating a storing and transportation of said billiard table, and a bottom board secured to said lower portions of said two first bars and said second bars, and a support device secured to said bottom board.

2. The billiard table according to claim 1, wherein said table top includes at least two first hinges pivotally secured between said first bars and said bottom surface of said table top, and at least two second hinges pivotally secured between said second bars and said bottom surface of said table top.

3. The billiard table according to claim 2, wherein said table top includes at least two depressions formed in said bottom surface thereof for receiving said at least two first hinges, and for allowing said bars to be folded to engage with said bottom surface of said table top.

4. The billiard table according to claim 3, wherein said table top includes at least two pads secured between said bottom surface thereof and said at least two second hinges for spacing said at least two second hinges from said table top, and for allowing said second bars to be folded and engaged onto said first bars after said first bars are engaged with said bottom surface of said table top.

5. The billiard table according to claim 1 further comprising a plurality of angles secured between said first bars and said second bars for securing said first bars and said second bars in said open position.

* * * * *